United States Patent [19]

Kitagawa et al.

[11] 4,355,970

[45] Oct. 26, 1982

[54] PRESSURE RESPONSIVE SAFETY VALVE FOR GAS BURNER

[75] Inventors: Kouichirou Kitagawa, Tokyo; Eiichi Kanno, Yokohama, both of Japan

[73] Assignee: Sekisui Kagaku Kogyo Kabushiki Kaisha, Osaka, Japan

[21] Appl. No.: 880,665

[22] Filed: Feb. 23, 1978

[30] Foreign Application Priority Data

| | | | |
|---|---|---|---|
| Feb. 23, 1977 | [JP] | Japan | 52/18860 |
| May 2, 1977 | [JP] | Japan | 52/51070 |
| Sep. 14, 1977 | [JP] | Japan | 52/110834 |
| Dec. 9, 1977 | [JP] | Japan | 52/148584 |

[51] Int. Cl.[3] ..... G05D 23/12

[52] U.S. Cl. ..... 431/77; 431/53; 431/19

[58] Field of Search ..... 92/134; 431/77, 53, 431/89, 19, 38, 63, 69; 251/65, 73

[56] References Cited

U.S. PATENT DOCUMENTS

| | | | |
|---|---|---|---|
| 2,538,222 | 1/1951 | Wilson | 431/19 |
| 2,597,787 | 5/1952 | Garner | 431/53 |
| 2,598,361 | 5/1952 | Dach | 251/65 |
| 2,956,132 | 10/1960 | Hilgert | 431/19 |
| 2,988,140 | 6/1961 | Strobel | 431/77 |
| 3,122,196 | 2/1964 | Schuss | 431/19 |
| 3,123,027 | 3/1964 | Livingston | 431/19 |
| 3,156,454 | 11/1964 | Flynn | 431/19 |
| 3,393,694 | 7/1968 | Baker | 251/65 |
| 3,422,841 | 1/1969 | Farrer | 251/73 |
| 3,479,927 | 11/1969 | Woodward | 92/134 |
| 3,527,761 | 6/1967 | Rowell | 251/73 |
| 3,602,250 | 8/1971 | Neenan | 251/65 |
| 3,711,236 | 1/1973 | Kinsella | 431/53 |
| 4,018,419 | 4/1977 | Monpetit | 251/65 |

*Primary Examiner*—Charles J. Myhre
*Assistant Examiner*—Carl Stuart Miller
*Attorney, Agent, or Firm*—Sughrue, Mion, Zinn, Macpeak & Seas

[57] ABSTRACT

A safety device for a gas burner comprises a first ignition nozzle 31 in a pilot burner 3, an inflammable gas guide tube 32 facing the first ignition nozzle, a second ignition nozzle 33 at the end of the guide tube oriented toward a main burner 2, a pressure sensing tube 6 coupled between the guide tube portion near the first ignition nozzle and one diaphragm chamber of a differential pressure sensing device 7, and an automatic valve 4 actuated by the pressure sensing device to close a main gas pipe 1. If the flame at the first ignition nozzle is extinguished the pressure near the beginning of the guide tube increases sharply, which actuates the pressure sensing device 7 to close the valve 4 and terminate combustion.

6 Claims, 9 Drawing Figures

PRESSURE RESPONSIVE SAFETY VALVE FOR GAS BURNER

BACKGROUND OF THE INVENTION

1. Field of the Invention

This invention relates to a safety device for a gas burner for preventing the leakage of raw gas when the pilot burner flame is unexpectedly extinguished and for preventing the leakage of injurious gas caused by incomplete combustion due to oxygen deficiency.

2. Description of the Prior Art

Conventionally, two types of devices have been used to detect the extinction of the pilot burner flame in a gas combustion system, one being a thermocouple type and the other being a flame rod type. The thermocouple type makes use of the heat of a flame. When a pilot flame is extinguished the temperature drops and the thermal electromotive force of the thermocouple is lost, whereupon it detects the extinction of the pilot flame and closes the main gas pipe valve. The thermal electromotive force is not lost until the temperature of the thermocouple has decreased to a certain level which often requires thirty or more seconds, however, and during this time raw gas continues to leak and can constitute great danger in a large volume gas combustion system. The flame rod type makes use of the electroconductivity and rectifying effect of a flame. It detects the extinction of a flame by applying a current through the flame, and closes the gas pipe valve accordingly. This type of device is capable of detecting the extinction of a flame with a very short response time as compared with the former type, but the use of electrical instruments makes the entire device larger and increases its cost. More importantly, however, neither type of device is capable of blocking the gas flow by sensing an oxygen deficiency.

SUMMARY OF THE INVENTION

The present inventors have noted that due to the volumetric expansion of a flammable gas during its combustion reaction with air, and the thermal expansion that accompanies such combustion, the flow rate of the gas beyond the ignition point at the end of a burner differs sharply between the cases where the gas is burning and where it is extinguished. Based on this principle the present inventors have developed a simple structure which can reliably detect the extinction of a flame with a short response time by sensing the pressure change accompanying the flow rate change when a burning gas is extinguished.

Briefly, and in accordance with the present invention, a pressure sensing tube is fed from a point just beyond the ignition nozzle of a pilot burner to a pressure sensing device which closes an automatic valve in the main gas pipe in response to a pressure increase, to thereby prevent any hazard resulting from the accidental extinction of the pilot flame. Specifically, by providing an inflammable gas guide tube just beyond the ignition nozzle of the pilot burner and a second ignition nozzle at the end of the guide tube oriented toward the main burner, any oxygen deficiency can also be sensed by controlling the air flow at the ignition point of the pilot burner. The pressure sensing tube communicates with the interior of the guide tube at its portion near the pilot burner ignition point.

BRIEF DESCRIPTION OF THE PREFERRED EMBODIMENTS

Figure 1:
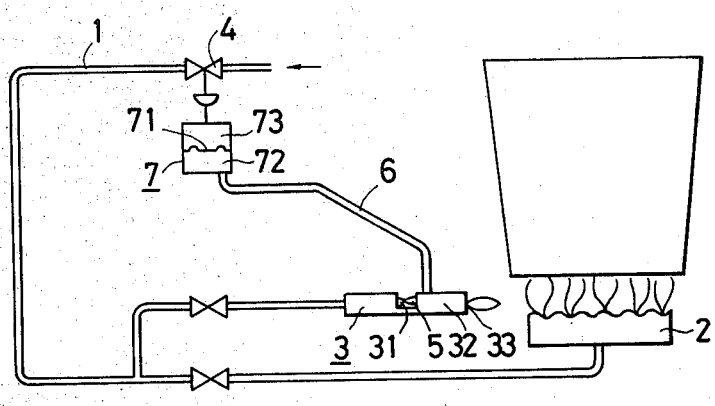
FIG. 1 shows one embodiment of a safety device for a gas combustion system according to this invention.
Figure 2:
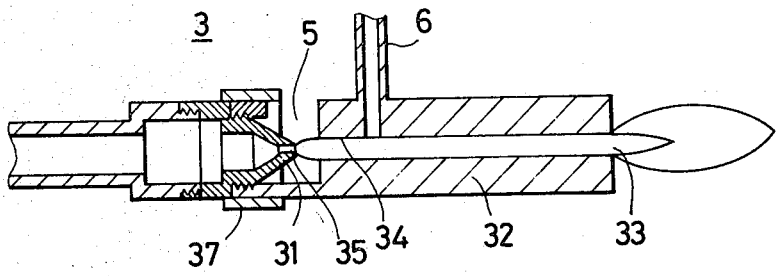
FIG. 2 shows a cross-section of one embodiment of a pilot burner of the safety device.

Referring now to the drawings, in the embodiment of FIG. 1 a main gas pipe 1 is branched into two pipes to supply a main burner 2 and a pilot burner 3. The main pipe 1 also passes through an automatic valve 4 controlled by a pressure sensing device 7 described below. As shown in FIG. 2, the pilot burner 3 comprises a tapered first ignition nozzle 31 followed by an inflammable gas guide tube 32, with some clearance therebetween to enable ignition. The tube 32 is coaxial with the nozzle 31 and ends in a second ignition nozzle 33 oriented toward the main burner 2. The guide tube 32 has an inner diameter 34 slightly larger than the aperture 35 of the first ignition nozzle 31 so that it may receive gas jetted from the first nozzle as well as draw in external air. This not only enables ignition and burning between the first nozzle 31 and the guide tube 32, but also causes the burning gas to turn into a hot gas stream when it is introduced into the guide tube 32. Because of the provision of the guide tube the flame at the first ignition nozzle 31 is more easily extinguished than that at the second ignition nozzle 33 by wind, lack of oxygen water or other factors which cause a sudden change in the released gas. The pilot burner 3 may alternatively be provided with a primary air hole 5 as in a conventional pilot burner if it is made slightly larger to allow ignition.

A pressure sensing tube 6 for detecting the pressure of the gas jetted from the first nozzle 31 is provided on the guide tube 32 at a point relatively close to the first nozzle. By connecting this tube 6 to a suitable pressure sensing device 7, the gas flow rate difference between the case where gas is burning at the first nozzle and the case where it is extinguished can be readily detected as a pressure difference.

Figure 4:
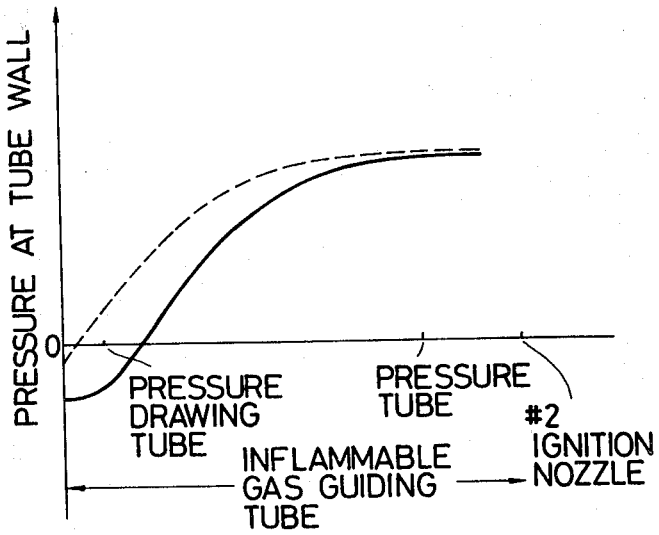
FIG. 4 shows a graph of the pressure distributions on the walls of an inflammable gas guide tube of the pilot burner, FIGS. 5, 6 and 7 each show cross-sections of other pilot burner embodiments.

Suppose the main pipe 1 is opened and both the first and second ignition nozzles 31, 33 are ignited. Because of the combustion reaction and thermal expansion, the burning gas flows through the guide tube 32 at a faster rate than when the nozzles have not been ignited and only raw gas and air are flowing through the tube. As FIG. 4 shows, the pressure distribution on the walls of the tube 32 is such that gas diffusion and tube resistance cause the pressure to increase as gas flows from the first nozzle 31 to the second nozzle 33, and substantial equilibrium is reached at the second nozzle. The solid line in FIG. 4 shows the case where the gas is burning and the dotted line shows the case where the gas is extinguished. Since burning gas flows more rapidly than extinguished or raw gas, the overall level of pressure distribution for the burning gas is lower than that for extinguished gas. As FIG. 4 shows, the pressure sensing tube 6 is disposed on the guide tube 32 at a point relatively close to the first nozzle 31 to thereby detect a negative pressure for the burning gas and a low positive pressure for the extinguished gas, and thus a significant pressure difference is detected between the two states of the gas.

The structure and dimensions of the pilot burner 3 may be properly determined by the kind and flow rate of gas, the aperture 35 of the first ignition nozzle 31, etc. In order that the pressure difference between the burning and extinguished gas is sufficiently large within the guide tube 32 to actuate the pressure sensing device 7, the tube 32 should have an inner diameter 34 of 2 mm or more. Too large a diameter only increases the amount of gas consumed by the pilot burner 3, however, and the preferred range is therefore from 2 to 3 mm. On the other hand, in case a burner wherein an outdoor pilot flame is used the flame should be large enough. Therefore the inner diameter of the pilot burner in that case may be larger than 3 mm. Further, in the burner in FIG. 5, it may be advisable to make the diameter of around 6 mm to prevent the pressure loss in the curved pipe due to the length thereof from occurring.

The gas stream jetted from the first nozzle 31 is preferably introduced into the guide tube 32 in such a manner that its diameter is substantially equal to the inner diameter 34 of the guide tube. For city gas the first nozzle 31 may have an inner diameter of about 0.3 to 1 mm and release gas at a flow rate of about 300 to 1400 ml/min, and more preferably an inner diameter of about 0.7 to 0.9 mm and a gas flow rate of about 800 to 1200 ml/min. The first nozzle 31 is preferably spaced 1 to 5 mm from the guide tube 32, and the latter is preferably 15 to 50 mm long. A shorter tube makes it difficult to achieve stable detection of a pressure difference, whereas a longer the tube cannot easily be incorporated into the combustion system.

The pressure sensing tube 6 may be provided on the guide tube 32 at a point where the maximum pressure difference is obtained, which is generally 7 to 20 mm from the end of the tube facing the first nozzle 31.

Figure 5:
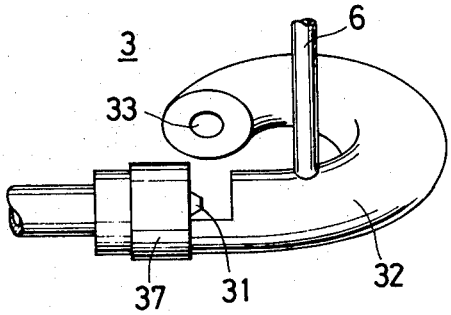
Figure 6:
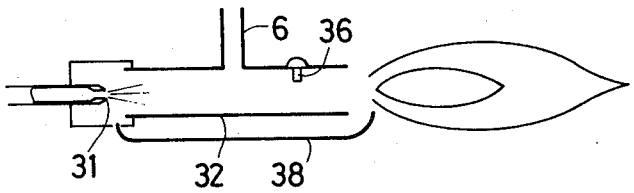

The pilot burner 3 is preferably designed so that ignition at the end of the first nozzle 31 immediately causes ignition at the second nozzle 33. FIG. 5 illustrates one embodiment wherein the guide tube 32 is bent to bring the first and second ignition nozzles close to each other. FIG. 6 illustrates another embodiment wherein part of the gas released from the end of the second nozzle 33 is directed along a guide plate 38 to the first nozzle 31, where it is ignited.

Figure 7:
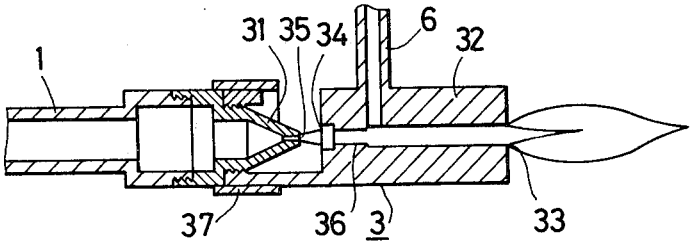

To amplify any difference in the pressure to be detected in the guide tube 32, a member 36 for controlling the cross-sectional area of the tube is preferably disposed within the tube at a point either before or after the pressure sensing tube 6. FIG. 7 illustrates one embodiment wherein the negative pressure detected when the flowing gas is ignited is amplified by a control member 36 which reduces the inner diameter of the tube 32 just before the pressure sensing tube 6.

As described above, the safety device of this invention uses the burning condition at the first nozzle 31 to detect a pressure change. So whether all the flames in the pilot burner 3 are extinguished or only the flame at the first nozzle 31, due to oxygen deficiency or the like, the flow through the guide tube 32 is only raw gas and air and its flow rate is decreased to enable pressure detection by the sensing tube 6. By providing an air flow controlling member at a suitable position on the pilot burner 3 to control the amount of air sucked between the first nozzle 31 and the guide tube 32, such as a slide cover 37, it becomes possible to close the main gas pipe 1 even when only the flame at the first nozzle 31 becomes extinguished due to oxygen deficiency because the air flow controlling member works to extinguish the flame at the first nozzle but keeps the flame at the second nozzle burning. Enclosing the lower half of the area between the first nozzle 31 and the guide tube 32 permits the flame at the first nozzle to be extinguished whenever the oxygen content in the air falls below 19%, which would otherwise result in incomplete combustion and possibly toxic fumes.

Figure 3:
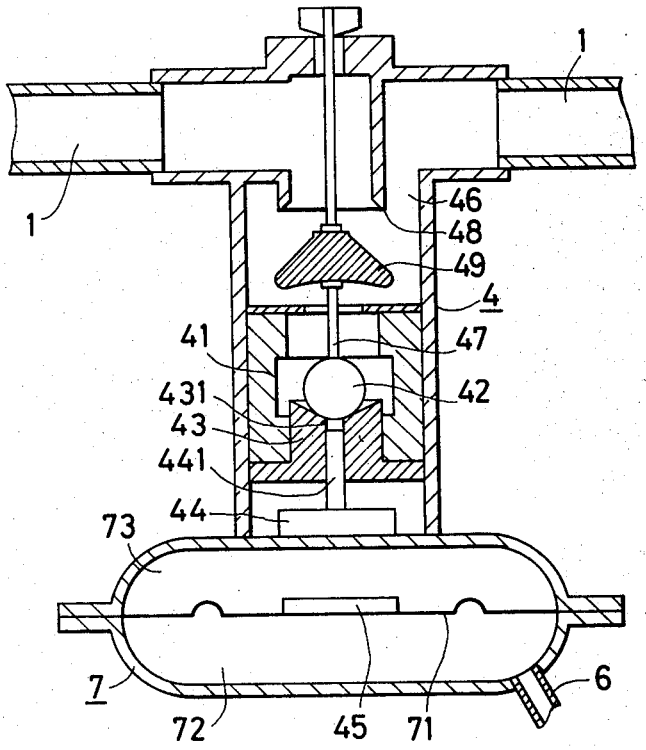
FIG. 3 shows a cross-section of one embodiment of a pressure sensing device and automatic valve of the safety device.

For simplicity of structure, it is desired to use a diaphragm valve as the pressure sensing device 7. FIG. 3 illustrates one example wherein compartments 72 and 73 are divided by a diaphragm 71 which changes its position depending upon a change in the fluid pressure differential. Since the pressure sensing tube 6 is arranged to communicate with compartment 72, a pressure change occurring within the guide tube 32 is transmitted through the tube 6 to the diaphragm 71 which then changes its position to possibly actuate the automatic valve 4.

The safety device of this invention is preferably protected against any damage of the diaphragm 71 by keeping the other compartment 73 under pressure, since once the diaphragm is broken and pressure is no longer applied to it, the diaphragm returns to an upper position to close the automatic valve 4 in a fail safe manner.

Figure 8:
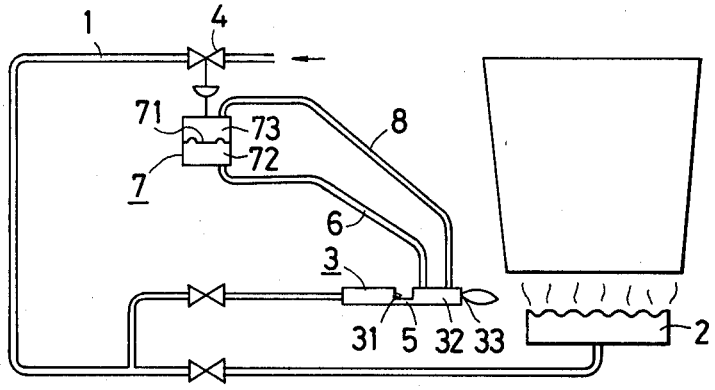
FIGS. 8 and 9 show other embodiments of the safety device according to this invention.

The compartment 73 may be held under pressure by confining pressurized gas therein or, as shown in FIG. 8, by leading a pressure tube 8 out of the guide tube 32 at a point close to the second nozzle 33 to provide a higher pressure than that within the pressure sensing tube 6 and by communicating the tube 8 with the compartment 73. As FIG. 4 shows, a positive pressure develops at a point in the guide tube 32 close to the second nozzle 33, and no significant pressure difference is produced at this point whether the gas is burning or extinguished.

For simplicity of structure it may be desired to use a magnetic switching mechanism for the automatic valve 4. One example of the magnetic switching mechanism is shown in the upper part of FIG. 3, wherein a magnetic ball 42 is accommodated within a cylindrical magnet 41. In the lower portion of the magnet 41 is a member 43 that supports the magnetic ball 42 under a balance between its own weight and magnetic effects. The inner circumference of the upper end of the cylindrical magnet 41 is slightly smaller to help the magnetic ball 42 move upward and establish contact therewith. The center of the support member 43 has a through hole 431 through which is inserted a rod 441 connected to a first magnet 44 disposed beneath the hole. A second magnet 45 is attached to part of the diaphragm 71 and generates a magnetic field that repels the first magnet 44. On top of the cylindrical magnet 41 is disposed a valve casing 46 connected to the main gas pipe 1. The top of the magnetic ball 42 engages the bottom end of a spindle 47, on which is mounted a valve 49 opposite a valve seat 48 to open or close the gas passage.

The upward movement of the diaphragm 71 brings the second magnet 45 closer to the first magnet 44, whereupon the first magnet is repelled upwardly together with the rod 441. This breaks the magnetic balance for the ball 42 whereby the ball is attracted upwardly into the upper end of the magnet 41, and the spindle 47 urges the valve 49 against its seat 48 to thereby close the gas passage of the main pipe 1.

The advantages of using a magnetic switching mechanism are, first of all, the elimination of electrical controls that use an external power supply, which reduces the size and complexity of the safety device. Secondly, the reliability of the device is significantly increased because it is not only capable of sensing the extinguishment of burning gas but it can also close the main gas pipe in an emergency such as an earthquake.

A possible modification of the embodiment shown in FIG. 3 is to omit the rod 441 that directly contacts the magnetic ball 42 and to use only the first magnet 44 to break the magnetic balance of the ball 42. The switching mechanism of the automatic valve 4 is most simply constructed as a magnet, as described above, or a microswitch that directly makes or breaks an electrical contact, but other means can also be employed. For example, an inductance converter that detects a change in magnetic flux when the magnetic core moves; a differential transformer that detects a change in electromotive force due to electromagnetic induction when a conductor is moved through the magnetic flux; a capacitance converter that detects a change in capacity when one of its electrodes is moved; and electrical converters such as a piezoelectric converter, resistance converter, a magneto-electric converter and a photoelectric converter. Still another switching method is to convert a pressure change to a change in other fluids such as air, liquid, etc. These switching mechanisms may be coupled with an electromagnetic valve.

In operation, opening the main cock (not shown) of the main gas pipe 1 and igniting the first ignition nozzle 31 of the pilot burner 3 causes the second ignition nozzle 33 at the end of the guide tube 32 to also ignite. The pilot flame at the second nozzle ignites the main burner 2. Before the first nozzle 31 is lit the automatic valve 4 must be opened by depressing the upper end of the valve spindle 47. When the gas burns at the first nozzle 31 it flows through the guide tube 32 at a fast rate so that the pressure sensing tube 6 and the compartment 72 of the pressure sensing device 7 are held under sufficiently reduced pressure to maintain the diaphragm 71 at its lower level.

If the flame at the first nozzle 31 unexpectedly becomes extinguished or dies away due to oxygen deficiency, only raw gas and air flow through the guide tube 32 and at such a decreased rate that the pressure in the tube 6 and compartment 72 sharply increases. The diaphragm 71 is therefore shifted upwards, the balance of the magnetic ball 42 is broken and the ball is drawn upwardly into the upper end of the cylindrical magnet 41, and the valve 49 engages its seat 48 to thereby close the main gas pipe 1.

Figure 9:
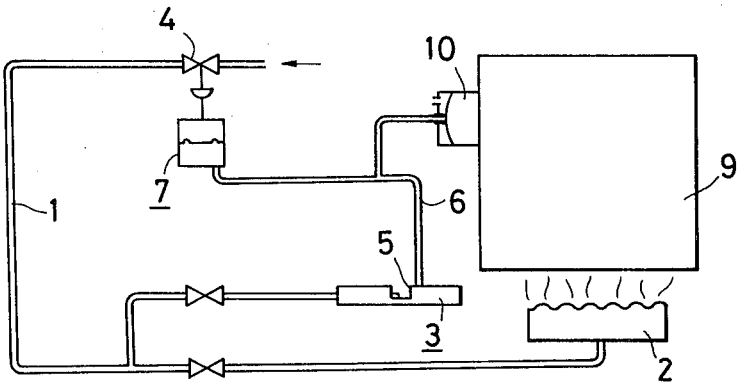

FIG. 9 illustrates a modification wherein the pressure sensing tube 6 is branched to communicate with an overheat-sensing valve 10 such as a bimetal installed on a heating device 9, such as a bath water heater. The valve 10 opens the pressure sensing tube 6 to atmosphere when the heating device 9 becomes overheated, and the increased pressure shifts the diaphragm 71 upwardly to close the automatic valve 4.

What is claimed is:

1. A safety device for a gas burner including an inflammable gas pipe and valve means disposed in said gas pipe, comprising: a first ignition means formed on an end portion of said gas pipe; an inflammable gas guide tube having one end facing first ignition means; a second ignition means formed on the other end of said guide tube; a branch pipe having one end connected to said gas pipe between said valve means and said first ignition means and the other end connected to burner means, said second ignition means facing said burner means; means for detecting the pressure in said guide tube comprising a pressure sensing device and a pressure sensing tube connected between a portion of said guide and said pressure sensing device, said pressure sensing tube being branched into two portions, one portion being connected to said pressure sensing device and the other portion being connected to an overheat-sensing valve on a vessel heated by said burner means; and means for controlling said valve means in response to a pressure variation in said guide tube.

2. The safety device as claimed in claim 1 wherein said overheat-sensing valve comprises a bimetal for opening the pressure sensing tube to the atmosphere in response to overheating.

3. A safety device for a gas burner including an inflammable gas pipe and valve means disposed in said gas pipe, comprising: a first ignition means formed on an end portion of said gas pipe; an inflammable gas guide tube having one end facing said first ignition means; a second ignition means formed on the other end of said guide tube; a branch pipe having one end connected to said gas pipe between said valve means and said first ignition means and the other end connected to burner means, said second ignition means facing said burner means; means for detecting the pressure in said guide tube comprising a pressure sensing device and a pressure sensing tube connected between a portion of said guide tube and said pressure sensing device; means for controlling said valve means in response to a pressure variation in said guide tube; and wherein said valve means comprises a cylindrical magnet, a magnetic member accommodated therein and supported under a balance between its own weight and magnetic force, a spindle having a bottom end engaging the top of said magnetic member, and a valve member mounted on said spindle for opening or closing the gas pipe, said magnetic member being movable by a shift of said diaphragm of said pressure sensing device to close said valve means.

4. The safety device as claimed in any one of claims 1, 2 and 3 wherein the inner diameter of said guide tube is sufficiently larger than that of said first ignition means to receive a stream of gas released from said first ignition means.

5. A safety device for a gas burner including an inflammable gas pipe and valve means disposed in said gas pipe, comprising: a first ignition means formed on an end portion of said gas pipe; an inflammable gas guide tube having one end facing said first ignition means; a second ignition means formed on the other end of said guide tube; a branch pipe having one end connected to said gas pipe between said valve means and said first ignition means and the other end connected to burner means, said second ignition means facing said burner means; means for detecting the pressure in said guide tube comprising a pressure sensing device and a pressure sensing tube connected between a portion of said guide tube and said pressure sensing device, said pressure sensing tube being connected to a portion of said guide tube near said first ignition means; means for controlling said valve means in response to a pressure variation in said guide tube; and means for controlling the cross-sectional area of a gas passage within said guide tube.

6. The safety device as claimed in claim 5, wherein said pressure sensing device has two pressure chambers separated by a diaphragm, said pressure sensing tube communicating with one of said chambers, the other chamber communicating with said guide tube at a point thereof which provides a higher pressure than that in said pressure sensing tube.

* * * * *